US005712619A

United States Patent [19]

Simkin

[11] Patent Number: 5,712,619

[45] Date of Patent: Jan. 27, 1998

[54] GLOBAL POSITIONING SYSTEM PERSONAL ALARM

[76] Inventor: Alan C. Simkin, 3705 Valley Rd., Ellicott City, Md. 21042

[21] Appl. No.: 634,590

[22] Filed: Apr. 18, 1996

[51] Int. Cl.[6] ..... G08B 1/08

[52] U.S. Cl. ..... 340/539; 340/825.49; 340/825.36; 340/573; 379/37; 379/38; 342/357

[58] Field of Search ..... 340/539, 825.49, 340/825.36, 573; 379/37, 38, 59; 455/33.1, 11.1; 342/357, 450, 457

[56] References Cited

U.S. PATENT DOCUMENTS 4,742,357 5/1988 Rackley ..... 342/457
4,750,197 6/1988 Denekamp et al. ..... 379/58
5,334,974 8/1994 Simms et al. ..... 340/990
5,555,286 9/1996 Tendler ..... 379/59

*Primary Examiner*—Donnie L. Crosland

[57] ABSTRACT

A new Global Positioning System Personal Alarm for providing a personal alarm system in the event of an assault, medical emergency, or any other intrusive wrong-doing whereby utilizing global positioning system technology and cellular phone technology to transmit the user's longitudinal and latitudinal position to a monitoring station which relays the user's position to the proper authorities. The device includes a housing structure, an alarm activating apparatus secured to the housing structure, an alarm means, a global positioning system positioned within the housing structure, a power source electronically connected to the global positioning system, and a cellular phone system electronically connected to the global positioning system.

2 Claims, 3 Drawing Sheets

GLOBAL POSITIONING SYSTEM PERSONAL ALARM

BACKGROUND OF THE INVENTION

1. Field of the Invention

The present invention relates to Emergency Devices and more particularly pertains to a new Global Positioning System Personal Alarm for providing a personal alarm system in the event of an assault, medical emergency, or any other intrusive wrong-doing whereby utilizing global positioning system technology and cellular phone technology to transmit the user's longitudinal and latitudinal position to a monitoring station which relays the user's position to the proper authorities.

2. Description of the Prior Art

The use of Emergency Devices is known in the prior art. More specifically, Emergency Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Emergency Devices include U.S. Pat. No. 5,414,432; U.S. Pat. No. 5,264,828; U.S. Design Pat. No. 331,717; U.S. Pat. No. 4,819,860; U.S. Pat. No. 5,043,736 and U.S. Pat. No. 4,932,910.

While these devices fulfill their respective, particular objectives and requirements, the aforementioned patents do not disclose a new Global Positioning System Personal Alarm. The inventive device includes a housing structure, an alarm activating means secured to the housing structure, an alarm means, a global positioning system positioned within the housing structure, a power source electronically connected to the global positioning system, and a cellular phone system electronically connected to the global positioning system.

In these respects, the Global Positioning System Personal Alarm according to the present invention substantially departs from the conventional concepts and designs of the prior art, and in so doing provides an apparatus primarily developed for the purpose of providing a personal alarm system in the event of an assault, medical emergency, or any other intrusive wrong-doing whereby utilizing global positioning system technology and cellular phone technology to transmit the user's longitudinal and latitudinal position to a monitoring station which relays the user's position to the proper authorities.

SUMMARY OF THE INVENTION

In view of the foregoing disadvantages inherent in the known types of Emergency Devices now present in the prior art, the present invention provides a new Global Positioning System Personal Alarm construction wherein the same can be utilized for providing a personal alarm system in the event of an assault, medical emergency, or any other intrusive wrong-doing whereby utilizing global positioning system technology and cellular phone technology to transmit the user's longitudinal and latitudinal position to a monitoring station which relays the user's position to the proper authorities.

The general purpose of the present invention, which will be described subsequently in greater detail, is to provide a new Global Positioning System Personal Alarm apparatus and method which has many of the advantages of the Emergency Devices mentioned heretofore and many novel features that result in a new Global Positioning System Personal Alarm which is not anticipated, rendered obvious, suggested, or even implied by any of the prior art Emergency Devices, either alone or in any combination thereof.

To attain this, the present invention generally comprises a housing structure, an alarm activating means secured to the housing structure, an alarm means, a global positioning system positioned within the housing structure, a power source electronically connected to the global positioning system, and a cellular phone system electronically connected to the global positioning system.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Global Positioning System Personal Alarm apparatus and method which has many of the advantages of the Emergency Devices mentioned heretofore and many novel features that result in a new Global Positioning System Personal Alarm which is not anticipated, rendered obvious, suggested, or even implied by any of the prior art Emergency Devices, either alone or in any combination thereof.

It is another object of the present invention to provide a new Global Positioning System Personal Alarm which may be easily and efficiently manufactured and marketed.

It is a further object of the present invention to provide a new Global Positioning System Personal Alarm which is of a durable and reliable construction.

An even further object of the present invention is to provide a new Global Positioning System Personal Alarm which is susceptible of a low cost of manufacture with regard to both materials and labor, and which accordingly is then susceptible of low prices of sale to the consuming public, thereby making such Global Positioning System Personal Alarm economically available to the buying public.

Still yet another object of the present invention is to provide a new Global Positioning System Personal Alarm which provides in the apparatuses and methods of the prior art some of the advantages thereof, while simultaneously overcoming some of the disadvantages normally associated therewith.

Still another object of the present invention is to provide a new Global Positioning System Personal Alarm for providing a personal alarm system in the event of an assault, medical emergency, or any other intrusive wrong-doing whereby utilizing global positioning system technology and cellular phone technology to transmit the user's longitudinal and latitudinal position to a monitoring station which relays the user's position to the proper authorities.

Yet another object of the present invention is to provide a new Global Positioning System Personal Alarm which includes a housing structure, an alarm activating means secured to the housing structure, an alarm means, a global positioning system positioned within the housing structure, a power source electronically connected to the global positioning system, and a cellular phone system electronically connected to the global positioning system.

Even still another object of the present invention is to provide a new Global Positioning System Personal Alarm wherein the user is able transmit their longitudinal and latitudinal position information to a monitoring station.

Still another object of the present invention is to provide a new Global Positioning System Personal Alarm that continuously transmits the user's longitudinal and latitudinal position in the event of an abduction.

Even still another object of the present invention is to provide a new Global Positioning System Personal Alarm which projects a loud and distinct noise in the event of an emergency.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
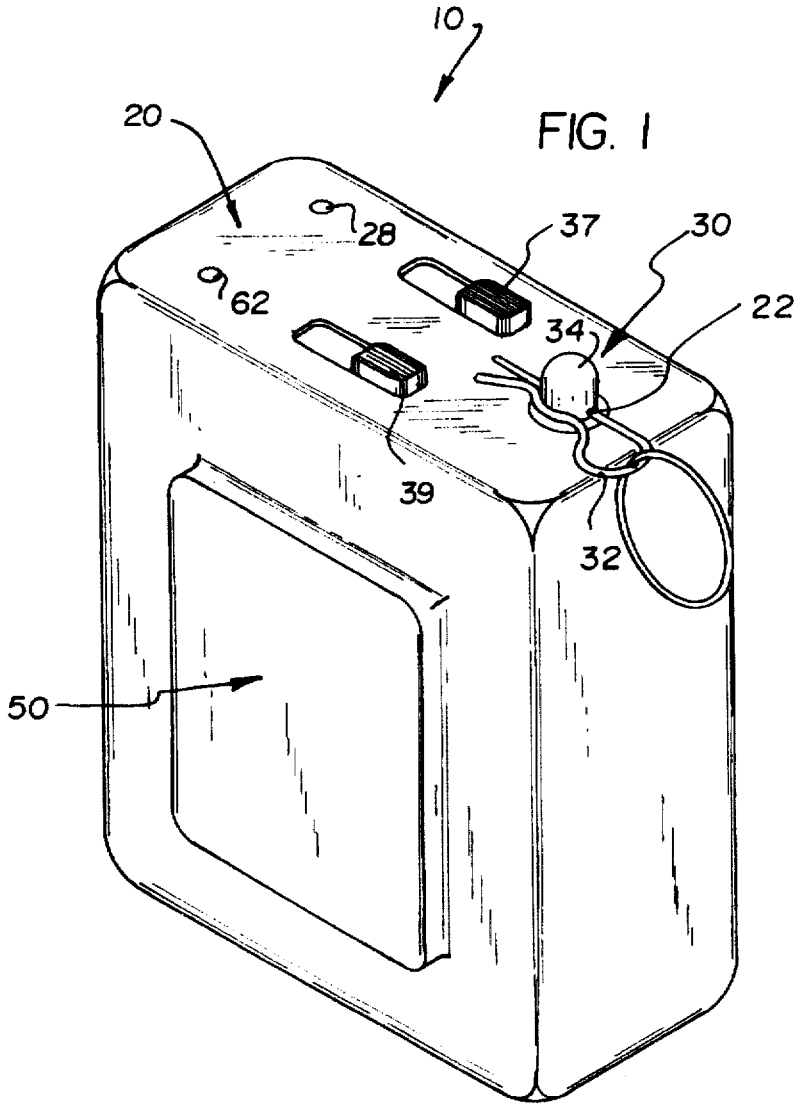
FIG. 1 is a right side perspective view of a new Global Positioning System Personal Alarm according to the present invention displaying the alarm activating means.

With reference now to the drawings, and in particular to FIGS. 1 through 5 thereof, a new Global Positioning System Personal Alarm embodying the principles and concepts of the present invention and generally designated by the reference numeral 10 will be described.

More specifically, it will be noted that the Global Positioning System Personal Alarm 10 comprises a housing structure 20 substantially rectangular shaped, a power source 60 positioned within the lower rear portion of the housing structure 20, an alarm activating means 30 secured to the housing structure 20 and electronically connected to the power source 60, an alarm means 40 electronically connected to the alarm activating means 30, a global positioning system 50 electronically connected to the power source 60 which receives longitudinal and latitudinal position information from a plurality of unnumbered global positioning satellites, a unnumbered cellular phone system electronically connected to the global positioning system 50 and the power source 60, and a unnumbered monitoring station receiving a unnumbered signal from the unnumbered cellular phone system where the unnumbered monitoring station converts the longitudinal and latitudinal information into a street address and relays the street address information to the proper authorities.

Figure 2:
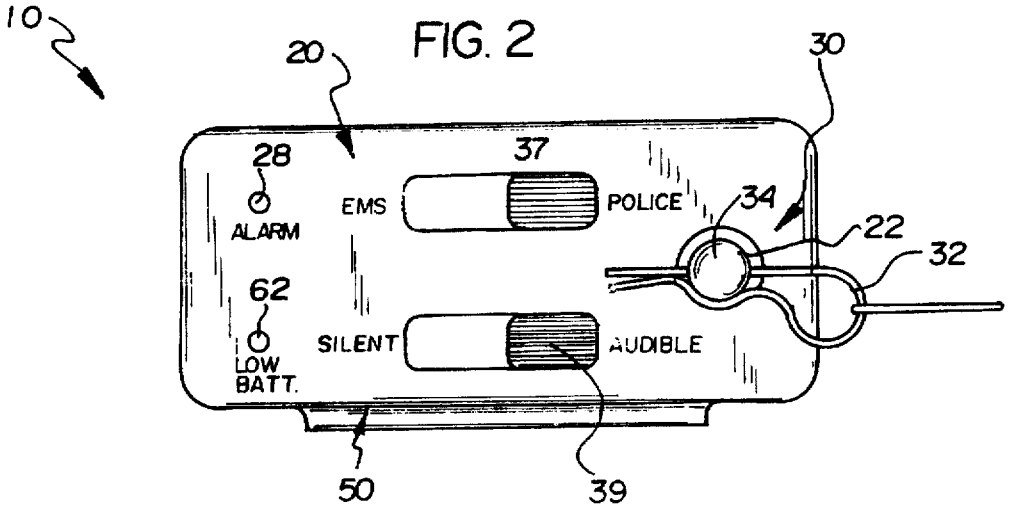
FIG. 2 is a top view further disclosing the alarm activating means.
Figure 3:
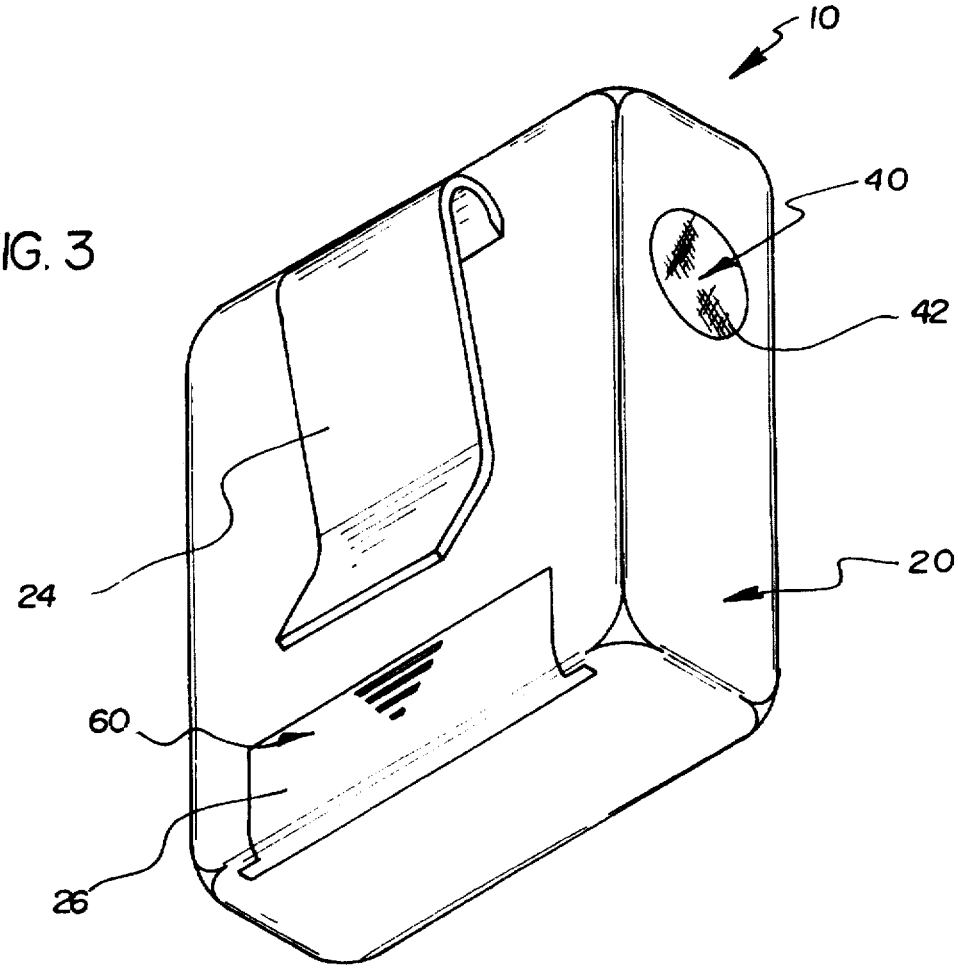
FIG. 3 is a lower rear side view of the present invention displaying the belt clip secured to the rear exterior surface of the housing structure and the alarm speaker.
Figure 4:
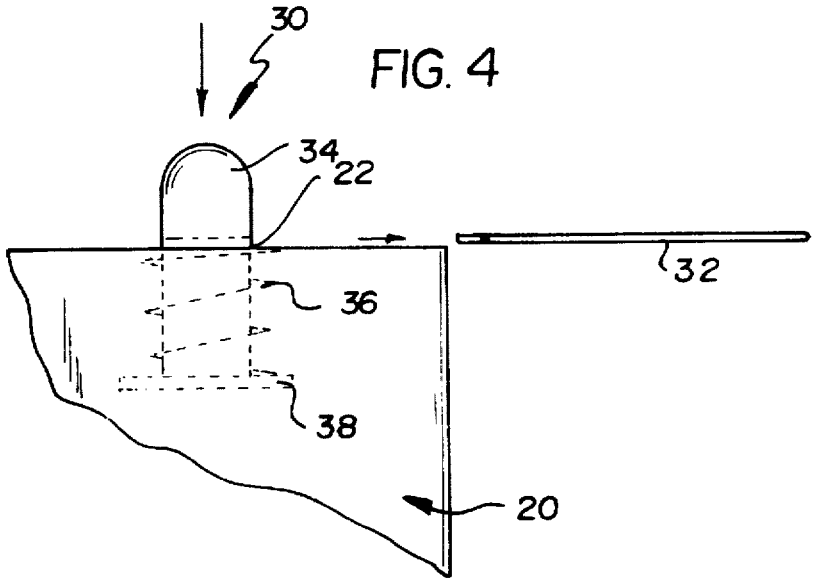
FIG. 4 is a cut-away view of the alarm activating means.
Figure 5:
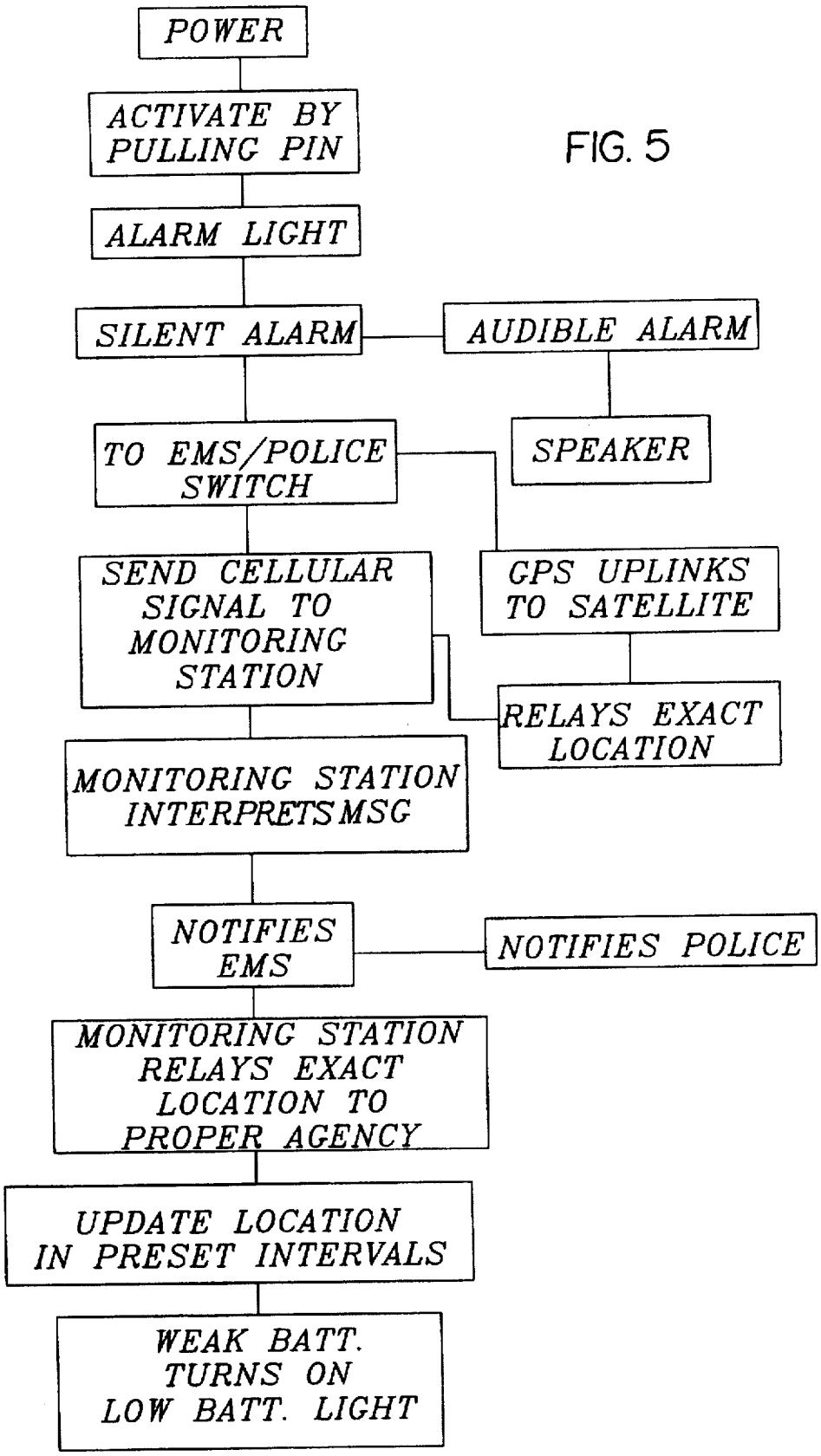
FIG. 5 is a flowchart of the present invention.

As best illustrated in FIGS. 1 through 5, it can be shown that the housing structure 20 includes a plunger aperture 22 positioned in the top surface of the housing structure 20. A belt clip 24 is secured centrally to the rear surface of the housing structure 20 allowing the user to couple the present invention to their belt. A battery door 26 is removably engaging the lower rear surface of the housing structure 20. An alarm light 28 is electronically connected to the alarm activating means 30 and secured to the top surface of the housing structure 20 displaying if the present invention's alarm activating means 30 has been activated. A low battery light 62 is electronically connected to the power source 60 displaying to the user if the power source 60 is depleted. An alarm speaker 42 is electronically connected to the alarm activating means 30 and secured to a side of the housing structure 20 as best shown in FIG. 3 of the drawings. The alarm activating means 30 includes a plunger member 34 projecting downwardly into the plunger aperture 22 of the housing structure 20 as best shown in FIG. 4 of the drawings. A compression spring 36 engages the interior surface of the housing structure 20. The compression spring 36 further surrounds the plunger aperture 22 and slidably receives the plunger member 34 as further shown in FIG. 4 of the drawings. A plunger head 38 is secured to the bottom end of the plunger member 34 within the housing structure 20 where the plunger head 38 is larger in diameter than the plunger aperture 22. The plunger head 38 engages the compression spring 36 opposite of the interior surface of the housing structure 20 as best shown in FIG. 4 of the drawings. The compression spring 36 applies a downward force to the plunger head 38 connected to the plunger member 34. A pull pin 32 slidably projects into the portion of the plunger member 34 exteriorly positioned from the housing structure 20. The pull pin 32 further engages the top surface of the housing structure 20 thereby preventing the plunger member 34 from descending into the housing structure 20 as best shown in FIGS. 1–2 and 4 of the drawings. An emergency service switch 37 is electronically connected to the unnumbered cellular phone system communicating the type of emergency involved by the user. An audible alarm switch 39 is electronically connected to the alarm speaker 42 allowing the user the option whether to have the alarm speaker 42 activated when the alarm activating means 30 is exercised.

In use, when the user encounters a dangerous situation the user simply pulls the pull pin 32 from the plunger member 34 thereby activating the alarm activating means 30. The global positioning system 50 determines the user's longitudinal and latitudinal position from information received from a plurality of unnumbered global positioning satellites. The unnumbered cellular phone system simultaneously calls the unnumbered monitoring station. The emergency service switch 37 communicates to the unnumbered monitoring station through the unnumbered cellular phone system what type of an emergency is involved. The global positioning system 50 communicates the user's position to the unnumbered cellular phone system which then relays the user's position to the unnumbered monitoring station. The unnumbered monitoring station translates the longitudinal and latitudinal information into a street address. The unnumbered monitoring station then relays the street address position of the user to the proper authorities along with what type of an emergency is involved.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A global positioning system personal alarm comprising:

a housing structure substantially rectangular shaped;

a power source positioned within a lower rear portion of the housing structure;

an alarm means for sounding an alarm;

an alarm activating means for activating said alarm means and being secured to the housing structure and being electronically connected to the power source; the alarm means being electronically connected to the alarm activating means, the alarm activating means including a plunger member mounted on said housing;

a global positioning system electronically connected to the power source for generating longitudinal and latitudinal position information based upon signals transmitted from a plurality of global positioning satellites and received by the global positioning system;

a cellular phone system for transmitting a signal containing said latitudinal and longitudinal position information when said alarm activating means is triggered, said cellular phone system being electronically connected to the global positioning system and the power source;

a monitoring station for receiving the signal containing said latitudinal and longitudinal position information from the cellular phone system, wherein the monitoring station converts the longitudinal and latitudinal information into street address information and relays the street address information to the proper authorities; and wherein the housing structure includes:

a plunger aperture positioned in the top surface of the housing structure and having said plunger mounted therein, said plunger triggering said alarm means through said alarm activating means when said plunger moves into said housing through said plunger aperture;

a belt clip secured centrally to the rear surface of the housing structure;

a battery door removably engaging the lower rear surface of the housing structure;

an alarm light electronically connected to the alarm activating means and secured to the top surface of the housing structure;

a low battery light electronically connected to the power source; and an alarm speaker electronically connected to the alarm activating means and secured to a side of the housing structure.

2. The global positioning system personal alarm of claim 1, wherein the alarm activating means includes:

a compression spring engages the interior surface of the housing structure which surrounds the plunger aperture and slidably receives the plunger member;

a plunger head secured to the bottom end of the plunger member within the housing structure where the plunger head is larger in diameter than the plunger aperture and where the plunger head engages the compression spring opposite of the interior surface of the housing structure;

a pull pin slidably projects into the portion of the plunger member exteriorly positioned from the housing structure and engages the top surface of the housing structure which prevents the plunger member from descending into the housing structure;

an emergency service switch electronically connected to the cellular phone system communicating the type of emergency involved; and an audible alarm switch electronically connected to the alarm speaker.

* * * * *